United States Patent [19]

Ramler

[11] 4,018,465

[45] Apr. 19, 1977

[54] DOOR OPENING DEVICE

[76] Inventor: David A. Ramler, 155 Shaw Road, Chestnut Hill, Mass. 02167

[22] Filed: Oct. 20, 1975

[21] Appl. No.: 624,269

[52] U.S. Cl. ..... 292/336.3; 74/557; 292/347

[51] Int. Cl.[2] ..... E05B 3/00

[58] Field of Search ..... 74/544, 557; 16/114 R; 248/DIG. 9, 475 A, 475 B; 292/336.3, 347, DIG. 2; 273/67 R

[56] References Cited

UNITED STATES PATENTS

| | | | |
|---|---|---|---|
| 428,442 | 5/1890 | Anderson | 74/557 |
| 1,579,119 | 3/1926 | Kloss | 74/557 |
| 2,645,488 | 7/1953 | Jorgenson | 273/67 R |
| 2,928,690 | 3/1960 | Larson | 292/336.3 |
| 2,942,909 | 6/1960 | Chase | 292/347 |
| 3,575,453 | 4/1971 | Hohl | 292/336.3 |
| 3,827,739 | 8/1974 | Overholser | 292/347 |

*Primary Examiner*—James C. Mitchell
*Attorney, Agent, or Firm*—Weingarten, Maxham & Schurgin

[57] ABSTRACT

A door opening device for use by handicapped persons for whom it is physically difficult or impossible to turn a conventional door knob. The device comprises, in one embodiment, an attachment hanging from a standard round door knob. Other embodiments included lever devices of different configurations also attached to a knob or the shank of a knob to facilitate turning thereof. This device enables a handicapped person to move the lever in either direction with an elbow, hand or other part of the body in order to open a door.

3 Claims, 4 Drawing Figures

DOOR OPENING DEVICE

FIELD OF THE INVENTION

This invention relates generally to devices for handicapped persons and more specifically to a novel door knob attachment enabling such persons to enter and exit through doors with relative facility.

BACKGROUND OF THE INVENTION

Aids for the handicapped are normally developed to alleviate a specific problem. For example, a wheelchair provides a means of locomotion for persons with certain types of handicaps. However, such persons, and those with other handicaps unrelated to locomotion, often find it very difficult to open a door by turning a conventional round door knob. Such knobs, having cylindrical locks therein, are widely used in homes and public buildings. Grasping and turning such a knob could be very difficult or even impossible for some people.

Modifications or revised configurations of cylindrical lock knobs or other round door knobs, which would facilitate opening doors by persons who find significant difficulty in operating such standard knobs, are not presently available. This makes such persons more dependent on others because they often need help in opening doors, thus limiting their ease of mobility.

SUMMARY OF THE INVENTION

The present invention provides an attachment for a door knob with a cylindrical type lock for use by handicapped persons in opening a door. This simple device, in a preferred embodiment, consists of a yoke-shaped handle attached to the outer circumference of a door knob by two pins or prongs integrally formed with the upper open portion of the yoke, and which pins fit into the knob through two diametrically opposed holes. The bottom portion of the attachment is a smaller loop-shaped lever which can be either pushed or pulled by the use of an arm, elbow or other part of the body in order to open a door.

In another embodiment of the invention the yoke-shaped handle is further attached to the knob by a stabilizing pin which extends from the bottom portion of the handle to another hole in the knob. Another embodiment provides a strap device clamped at one end around the shank portion behind the door knob. The attachment in this embodiment consists of a J-shaped bar which extends horizontally from the knob shank. Still another embodiment includes an open loop-shaped lever door knob attachment which is also clamped to the door knob shank.

Each of the embodiments of the invention is configured to break when excessive turning or axial twisting forces are applied, before the knob or shank is broken or otherwise made inoperative. Thus the device cannot be made the means of forcible entry through a locked door.

This invention thus provides a simple, safe yet positive device to facilitate opening a door where a person has insufficient manual dexterity to grasp and turn a conventional knob. Any round door knob can be easily converted to a knob especially suitable for operation by handicapped persons by means of the device of this invention.

DESCRIPTION OF THE DRAWINGS

The advantages, objects and features of this invention will be more fully understood from the following detailed description taken in conjunction with the accompanying drawing in which.

DETAILED DESCRIPTION OF THE INVENTION

Figure 1:
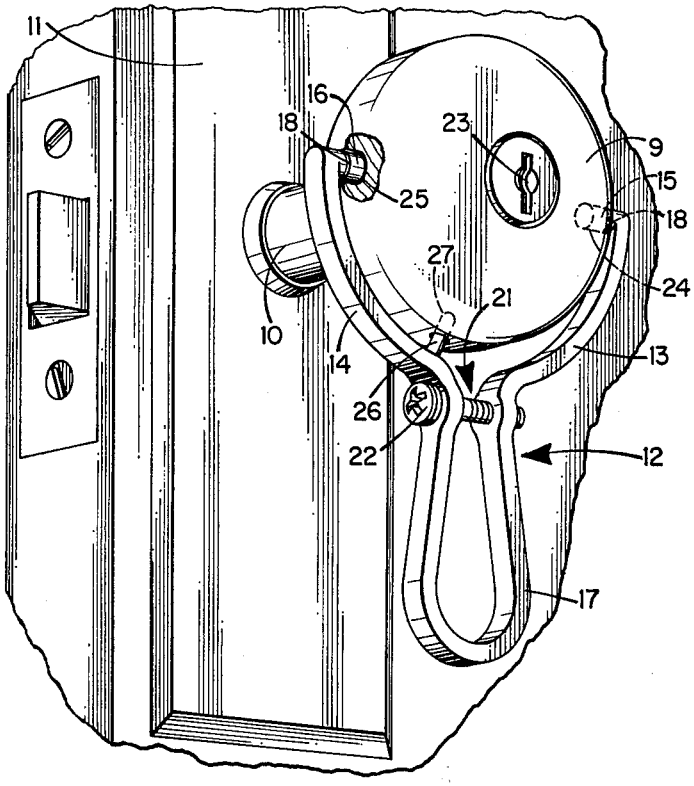
FIG. 1 is a perspective view of a door knob with the attachment of the present invention.

Referring now to the drawing, and more specifically to FIG. 1 thereof, there is shown door knob 9 having shank 10 and being mounted to door 11. Door opening lever device 12 constructed in accordance with the present invention is attached to the knob. The upper portion of the device is formed as a yoke having curved arms 13 and 14 terminating in radially inwardly projecting pins 15 and 16 respectively. The bottom portion of lever 12 is formed as a loop 17 having an open upper end 21 wherein the sides of the loop are joined with arms 13 and 14 of the yoke to make an integral device. The lower portion of the yoke and the upper portion of loop 17 are joined together by adjustable means such as bolt 22. Of course this adjustable device may take on any other suitable form. Bolt 22 may have a nut at one end or one side of the loop may be threaded to receive the threaded end of the bolt so that opening 21 may be widened or narrowed as desired.

Knob 9 is shown as a conventional cylindrical lock knob having a lock 23 mounted therein but the invention is not broadly limited to this type of knob. Diametrically opposed holes 24 and 25 are made in the circumference of the knob to receive pins 15 and 16 respectively. After the holes have been drilled, lever 12, in its most open condition, is put in place and bolt 22 is tightened so that pins 15 and 16 move axially toward each other thereby clamping the device to the knob with pins 15 and 16 in their respective holes. In this manner, the attachment may be tightened to make a very positive coupling with the knob so that any lateral force exerted on loops 17 will cause the knob to turn without the danger of the lever becoming separated therefrom.

A desirable modification to the device is shown in FIG. 1 wherein a stabilizing pin 26 is mounted to one of the yoke arms of the attachment and projects into a third hole 27 in the knob. This prevents the loop from moving toward or away from the door when lateral forces substantially parallel to the door are applied to loop 17. It may be recognized that lever 12 may, absent pin 26, pivotally swing about pins 15 and 16 toward and away from the door if there is a force component exerted upon loop 17 which is not exactly parallel to the door plane.

While pins 15 and 16 are shown as an integral extension of the yoke arms 13 and 14, annular score lines 18 indicate that these pins may be broken off from the yoke arms when excessive force is applied to loop 17. The scores are sufficiently deep so that the attachment will break well before the knob or its shank can break or be twisted in such a way as to damage the lock or open the door when the lock is engaged.

Figure 2:
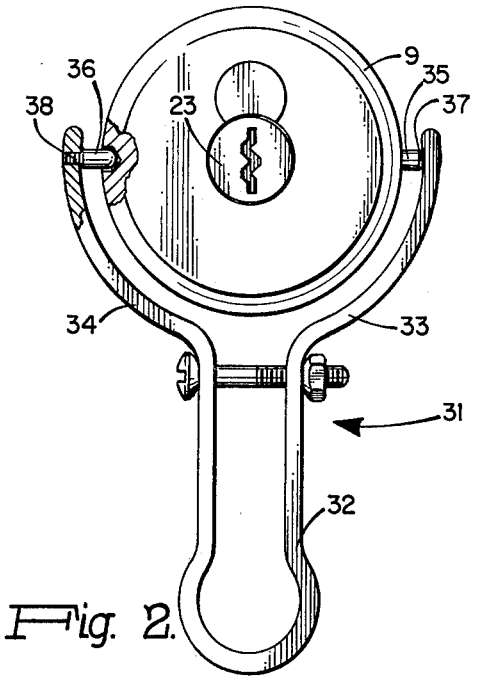
FIG. 2 is a front view of an alternative embodiment of the door knob attachment of FIG. 1.

Lever device 31 shown in FIG. 2 is similar in construction and operation to lever 12 shown in FIG. 1. Loop portion 32 has a slightly different configuration from that of loop 17 of FIG. 1 but it is recognized that any projection below the yoke arms would be satisfactory. Yoke arms 33 and 34 are substantially similar to arms 13 and 14 of FIG. 1. Diametrically opposed pins 35 and 36 may be attached to respective yoke arms 33 and 34 by any suitable means such as a threaded engagement or butt welding.

Pin 35 of the embodiment of FIG. 2 is shown connected to arm 33 by butt welding and has score lines 37 similar in purpose to scores 18 in the FIG. 1 embodiment. Alternatively, if the pin is mounted in a threaded manner as is pin 36, by making the threaded shank 38 with a reduced diameter from that of the pin itself, the purpose of permitting it to break before the knob breaks may be accomplished.

Figure 3:
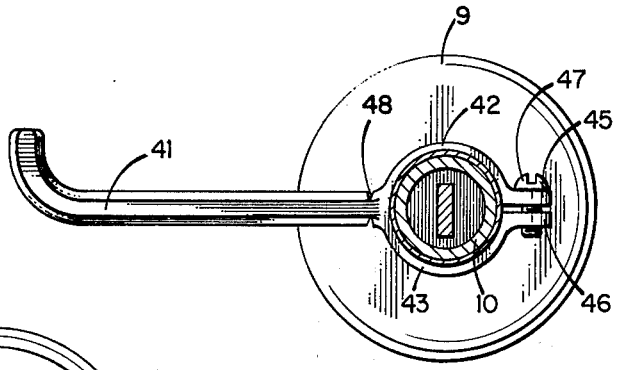
FIG. 3 is a sectional view through the knob shank showing another alternative embodiment of a door knob attachment according to the invention.

In the embodiment shown in FIG. 3, the lever extends horizontally from the shank of knob 9 and comprises elongated hexagonal J-shaped arm 41 having opposed arcuate portions 42 and 43 surrounding shank 10. These arcuate portions continue into confronting tabs 45 and 46 which are joined together by some suitable means such as bolt 47 to form a clamp around the shank. Arm 41 may be comprised of two parallel members which extend over the shank of the door knob and which may be attached by spreading ends 45 and 46 sufficiently to encompass the shank. Alternatively the arm may be made of one piece wherein it would be axially slid over the shank and clamped in place before the knob is finally mounted to the door. Lever arm 41 is formed with notches 48 adjacent the knob shank to permit it to break with either excessive rotational forces when the door is locked or with axial twisting forces exerted toward or away from the door.

Figure 4:
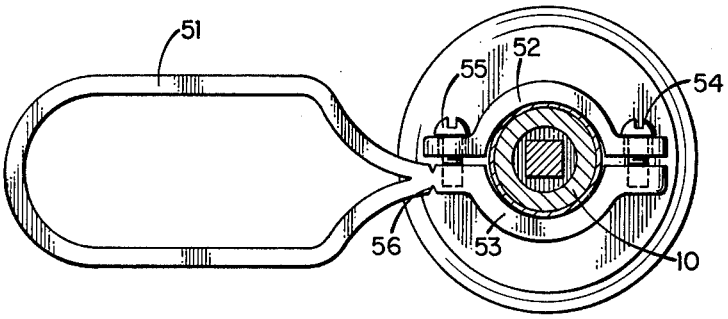
FIG. 4 is a sectional view through the knob shank showing another alternative embodiment of the present door knob attachment.

Another embodiment of the invention similar to FIG. 3 is shown in FIG. 4, wherein an open loop lever arm 51 is clamped to shank 10 by means of arcuate elements 52 and 53 and suitable engaging means such as bolts 54 and 55. It may be seen that the device of FIG. 4 can easily be attached to a door knob shank at any time after the knob has been mounted to the door. Arcuate element 52 is shown as a separate element while arcuate element 53 is an extension of the closed end of lever arm 51. Lever 51 is also formed with notches or annular groove 56 to permit it to break with the application of excessive forces as previously described.

The door opening device of this invention may be made of any suitable material such as plastic, stiff aluminum wire or cast aluminum, among others. From the embodiments disclosed, it would be a relatively simple matter to devise several other embodiments which are within the scope of this invention. For example, either of the attachments shown in FIG. 3 or FIG. 4 could be made with an element which wraps around the shank and is clamped back on itself on the left side of the shank as shown in each of these figures. While the embodiments of FIGS. 1 and 2 show attachment to the knob with diametrically opposed pins, the holes and mating pins could be at some other location on the knob periphery. Other shapes and clamping devices could easily be used. The embodiments of FIG. 1 and FIG. 2 could as easily project upward rather than downward from the knob. The number of alternative possibilities is thus seen to be quite large.

What is claimed is:

1. A device for assistance in opening a door having a round knob and a shank extending from the knob through said door, said device comprising:

an elongated lever arm; and means for coupling said lever arm to said knob in such a manner that said knob rotates when forces are applied to said lever arm which are substantially parallel to the plane of said door;

said lever arm comprising a pair of yolk arms encompassing at the open ends of said yolk arms a portion of the periphery of said knob;

said means for coupling said lever arm to said knob comprising diametrically opposed pins formed on the ends of said yolk arms, said knob being formed with diametrically opposed holes in the periphery thereof, said ends being seated in said holes in said knob.

2. The device recited in claim 1 wherein said knob is further formed with a stabilizing pin hole in its periphery spaced from said diametrically opposed holes, said device further comprising:

a stabilizing pin secured to one of said yoke arms and projecting into said stabilizing pin hole.

3. The device recited in claim 1 wherein each of said diametrically opposed pins is scored at its connection with said yoke arms to enable said lever to break when excessive forces are applied thereto before damage occurs to said knob or said shank.

* * * * *